US006251251B1

(12) United States Patent
Uzoh et al.

(10) Patent No.: US 6,251,251 B1
(45) **Date of Patent: *Jun. 26, 2001**

(54) ANODE DESIGN FOR SEMICONDUCTOR DEPOSITION

(75) Inventors: Cyprian E. Uzoh, Hopewell Junction; Panayotis C. Andricacos, Croton-on-Hudson; John Owen Dukovic, Poughkeepsie; Robert P. Westerfield, Jr., Montgomery, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/192,431

(22) Filed: Nov. 16, 1998

(51) Int. Cl.[7] ..... C25D 21/18

(52) U.S. Cl. ..... 205/99; 205/97; 205/123; 205/292; 204/285; 204/283; 204/287; 204/280; 204/297 R; 204/224 R; 204/252; 204/263; 204/259; 204/266; 204/278

(58) Field of Search ..... 204/297 R, 280, 204/283, 284, 242, 297.11, 285, 287, 224 R, 252, 263, 259, 266, 278; 205/157, 108, 292, 595.11

(56) References Cited

U.S. PATENT DOCUMENTS

| | | |
|---|---|---|
| 2,689,216 | 9/1954 | Nevers et al. . |
| 2,923,671 | 2/1960 | Van Tilburg . |
| 3,300,396 | 1/1967 | Walker . |
| 3,317,410 | 5/1967 | Croll et al. . |
| 3,558,464 | 1/1971 | Danna . |
| 3,652,442 | 3/1972 | Powers et al. . |
| 3,809,642 | 5/1974 | Bond et al. . |
| 3,962,047 | 6/1976 | Wagner . |
| 4,032,422 | 6/1977 | Ross et al. . |
| 4,233,146 | 11/1980 | Rothmayer et al. . |
| 4,304,641 | 12/1981 | Grandia et al. . |
| 4,323,438 | 4/1982 | Sesterhenn et al. . |
| 4,466,864 | 8/1984 | Bacon et al. . |
| 4,469,564 | 9/1984 | Okinaka et al. . |
| 4,596,637 | 6/1986 | Kozarek et al. . |
| 4,664,760 | 5/1987 | Jarrett . |
| 4,906,341 | 3/1990 | Yamakawa et al. . |

(List continued on next page.)

OTHER PUBLICATIONS

D. Edestein, "Advantages of Copper Interconnectors," Jun. 27–29, 1995, VMIC Conference—1995 ISMIC—104/95/0301.

D. Edestein, et al., "Full Copper Wiring in a Sub–0.25 um CMOSULSI Technology," IEEE IEDM, Washington, D.C. Dec. 7–10 (1997) pp. 301–307.

D. Edelstein, "Integration of Copper Interconnects," ECS 1996 No month available.

Equinox, Single Substrate Processing System, SEMITOOL. Advertising Brochure. EQU–025, 4/94 pp. 108.

EQUINOX, Introducing the First Fully End–to–End Plating Pricess, SEMITOOL Advertising Brochure, EQU:1002 6 pgs. 12/94.

*Primary Examiner*—Kathryn Gorgos
*Assistant Examiner*—Christopher M Keehan
(74) *Attorney, Agent, or Firm*—Connolly Bove Lodge & Hutz LLP

(57) ABSTRACT

An anode assembly including a perforated anode. A perforated anode holder holds the anode. The anode holder includes perforations at least in a bottom wall such that plating solution may flow through perforations in the anode holder and perforations in the anode. An anode isolator separates the anode and a cathode. The anode isolator includes at least one curvilinear surface.

27 Claims, 7 Drawing Sheets

U.S. PATENT DOCUMENTS

| | | | | |
|---|---|---|---|---|
| 4,931,150 | | 6/1990 | Smith . | |
| 5,000,827 | | 3/1991 | Schuster et al. . | |
| 5,023,044 | | 6/1991 | Negron . | |
| 5,222,310 | | 6/1993 | Thompson et al. . | |
| 5,228,966 | | 7/1993 | Murata . | |
| 5,318,683 | | 6/1994 | Smith et al. . | |
| 5,377,708 | | 1/1995 | Bergman et al. . | |
| 5,391,285 | | 2/1995 | Lytle et al. . | |
| 5,429,733 | | 7/1995 | Ishida . | |
| 5,431,823 | | 7/1995 | Gofer . | |
| 5,435,885 | | 7/1995 | Jones et al. . | |
| 5,437,777 | | 8/1995 | Kishi . | |
| 5,443,707 | | 8/1995 | Mori . | |
| 5,447,615 | | 9/1995 | Ishida . | |
| 5,514,258 | * | 5/1996 | Brinket et al. | 204/237 |
| 6,113,759 | * | 9/2000 | Uzoh | 204/285 |

* cited by examiner

ANODE DESIGN FOR SEMICONDUCTOR DEPOSITION

FIELD OF THE INVENTION

The invention relates to electroplating materials on a substrate. In particular, the invention relates to an anode assembly utilized in electroplating materials on a substrate. The invention also relates to an electroplating system including the anode assembly. Furthermore, the present invention includes a method of electroplating a material on a substrate that includes utilizing the anode assembly and curvilinear or cylindrical diffuser.

BACKGROUND OF THE INVENTION

In the production of microelectronic devices, metal may be plated on a substrate for a variety of purposes. Typically, metal is plated on the substrates in cells or reservoirs that hold a plating solution that includes at least one metal to be plated on the substrate.

Composition of plating baths and conditions within the plating bath must be carefully controlled to produce deposition of a desired quality of desired metal(s) on a substrate. Plating rate, uniformity, and deposit quality may be affected by a variety of factors. For example, among the parameters that may affect rate, uniformity, and deposit quality of plating are concentration of chemicals in the plating bath, nature and distribution of electrical contacts and voltage within the plating system. The physical design of an electroplating system may affect the conditions within the system and the plating carried out in the system.

SUMMARY OF THE INVENTION

The present invention provides an anode assembly that includes a perforated anode. A perforated anode holder holds the anode. The anode holder includes perforations at least at a bottom wall such that plating solution may flow through perforations in the anode holder and perforations in the anode. An anode isolator separates the anode and a cathode. The anode isolator includes at least one curvilinear surface.

The present invention also relates to an electroplating system. The electroplating system includes a plating tank for holding a plating solution including at least one metal to be plated on at least one substrate. A perforated anode holder is arranged within the plating tank for holding an anode. The anode holder includes perforations at least in a bottom wall such that plating solution may flow through perforations in the anode holder and perforations in the anode. A perforated anode is arranged within the anode holder. An anode isolator separates the anode and a cathode. The anode isolator includes at least one curvilinear surface.

Additionally, the present invention relates to a method of electroplating material on a substrate. The method includes providing an electroplating system such as described above. At least one substrate is introduced into the plating tank. Current is supplied to the at least one substrate to result in the plating of at least one metal contained within the plating solution onto at least a portion of the substrate.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Figure 1:
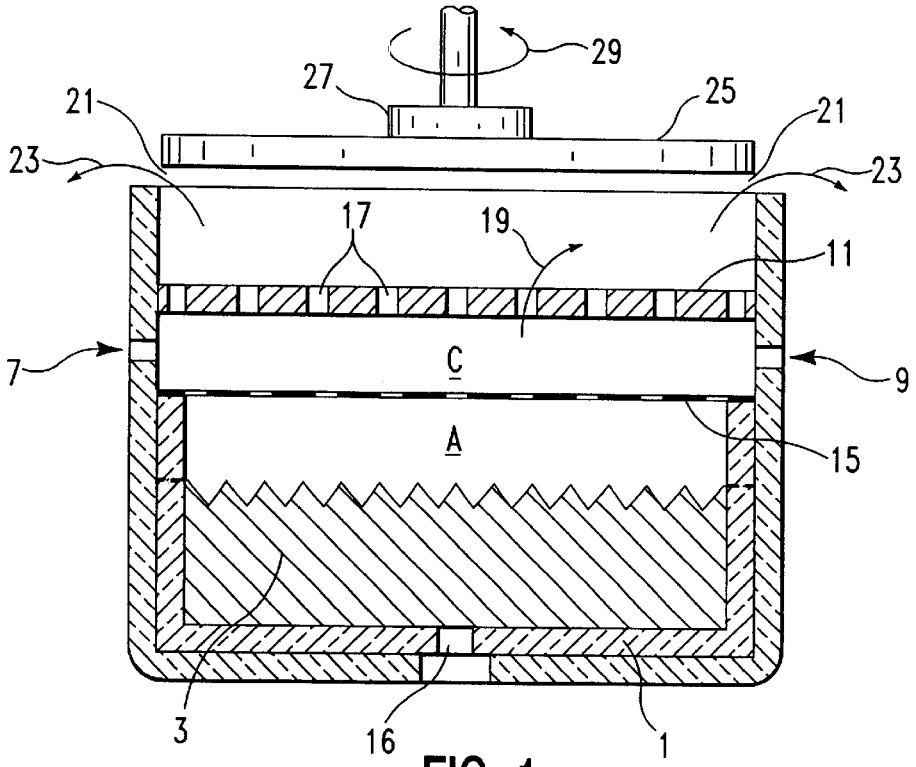
FIG. 1 represents a cross-sectional view of an embodiment of an anode assembly.

FIG. 1 illustrates an example of an anode assembly. The anode assembly shown in FIG. 1 includes an anode cup or holder 1. The anode cup or holder 1 may support an anode 3 arranged therein. The anode holder 1 may include at least one hole 1*b* for electrical contact to the anode.

Figure 2:
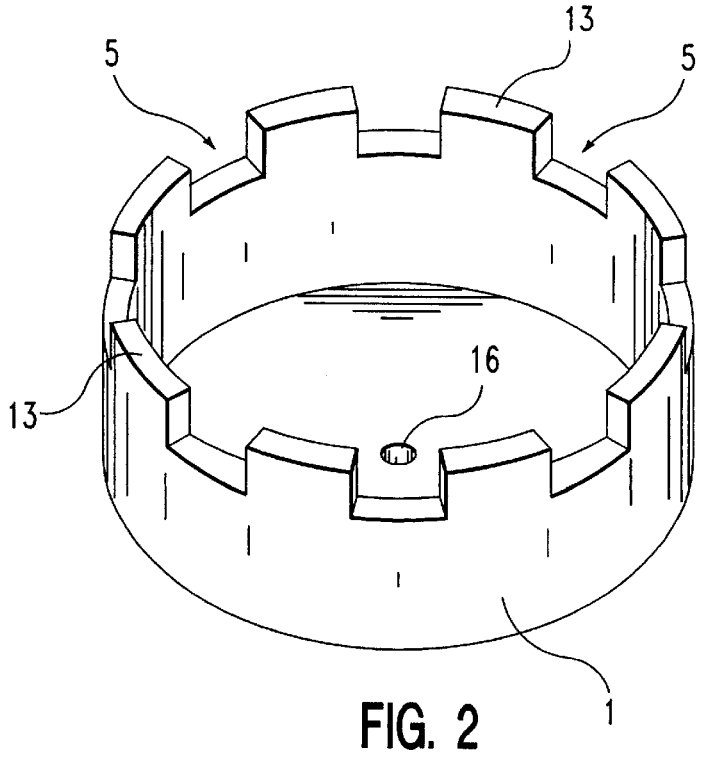
FIG. 2 represents a perspective view of an embodiment of an anode holder that forms a part of the anode assembly shown in FIG. 1.

FIG. 2 illustrates a perspective view of the anode holder 1 shown in FIG. 1. Plating solution may enter the anode cup or holder 1 through at least one plating solution inlet 5. Flow of plating solution into the anode holder or cup through inlets 5 is illustrated by arrows 7 and 9 in FIG. 1.

Anode cup or holder 1 may support a diffuser 11. A diffuser is a plate with perforations, it redistributes the flow of a fluid from a non-uniform pattern to a more uniform one or to that of some intended flow pattern. The diffuser may be supported by the anode cup or holder 1 or by another structure within the plating system, such as the plating bath reservoir. If the diffuser is mounted on the anode cup or holder 1, the anode cup or holder may include a surface 13 for mounting the diffuser. The diffuser could also be mounted on another structure in the anode assembly or in an electroplating cell that includes the anode assembly.

The anode may be isolated within the anode assembly by an anode bag or filter 15. The anode bag or filter 15 may be attached to the anode cup or holder 1. Unlike the diffuser, which may be attached to the anode cup or holder such that plating solution may flow into plating solution inlets 5, the anode bag or filter may be attached to the anode cup or holder such that no open spaces such as openings 5 exist. In other words, any materials must pass through the anode bag or filter. The anode bag or filter divides the anode assembly shown in FIG. 1 into 2 sections, the "A" section or anode section of the anode assembly and "C" section or cathode section of the anode assembly.

Plating solution may pass through openings 17 in diffuser 11 as indicated by arrow 19. The plating solution may exit the anode assembly at openings 21 as indicated by arrows 23.

Arranged in the vicinity of the anode assembly is a cathode including a workpiece or substrate 25, such as a semiconductor wafer, on which materials, such as at least one metal or and or at least one alloy are to be electroplated. The substrate may be supported by a support 27. The support may include a workpiece support portion that extends out having the same cross-sectional area or substantially the same cross-sectional area as the substrate 25. The substrate support 27 and attached substrate 25 may rotate as indicated by arrow 29.

The embodiment of the anode assembly illustrated in FIG. 1 and the anode cup or holder illustrated in FIG. 2 are not preferred since problems may exist with them. For example, during routine plating operations, as electroplating proceeds and the anode is consumed, the anode may generate particles, typically called anode fines. As the amount anode fines increases, they form a sludge over the anode, typically referred to as anode sludge.

As electroplating continues and the anode continues to be consumed, the anode sludge continues to thicken. As the sludge thickens, it occupies more and more of the space between the anode bag or filter and the anode. The generation of anode fines and the resulting problems may be especially prevalent when carrying out copper electroplating from a copper acid bath utilizing a soluble CuP anode.

A number of problems are associated with anode sludge. for example, the anode sludge may cause a voltage drop in the electroplating cell because ions have to migrate through the sludge to the plating solution. As a result, plating voltage may rise. A rising plating voltage may effect the deposit uniformity. The effects of the anode sludge may depend upon cell design and plating parameters, among other factors. Additionally, the anode sludge is a particulate matter, which can be incorporated into the structure of the plated metal.

As a result of anode sludge formation and the degradation in plating, such as degraded plating uniformity that may result, anode maintenance typically is practiced in electroplating systems. Anode maintenance may include removal of the anode from the cell. After removal, excess sludge may be scraped off of the anode. The anode may then be etched in a suitable solution to remove remaining sludge. The anode may then be subjected to one or more lengthy anode reconditioning steps. The reconditioning step(s) may last for about 5 to about 16 hours. The length of the anode reconditioning step may depend upon the skill of the plater.

Anode fines forming the anode sludge may also escape from the area around the anode and contaminate a workpiece being plated. As a result, anode assemblies typically include an anode bag or filter 15 such as that shown in FIG. 1. The anode bag basically isolates the anode in the anode assembly and helps to prevent the incorporation of particles from the sludge in the plated workpiece. In an electroplating apparatus, such as the cup plating cell illustrated in FIG. 1, the anode and the workpiece or wafer to be plated may face each other. Often, with such a configuration, the anode is arranged below the workpiece or wafer facing upward, toward the workpiece or wafer.

To reduce the incorporation of anode fines into the plated film, an anode bag or filter may be used to separate the anode from the workpiece. The bag acts as a containment for the anode sludge.

Utilization of an anode bag or filter may result in another series of problems. For example, gas bubbles, such as air bubbles, may be trapped between the anode and the anode bag. Gas bubbles may interfere with electric field lines between the anode and the wafer or workpiece. Interference with the electrical field within the electroplating system may result in overpotential. The overpotential may cause the plating voltage to rise in an erratic manner until the power supply reaches its set compliance voltage and shuts off. Disturbance in the electrical operation caused by gas bubbles may also effect the uniformity of electrodeposits. For example, the uniformity may be erratic. The thickness of plated films tends to be thinner in the region adjacent to the bubbles.

An additional problem associated with the anode assembly design illustrated in FIG. 1 is that it may permit only limited mixing of plating solution between the two sides of the anode bag or filter occurs. This results, at least in part, from plating solution being trapped below the anode bag and limited mixing taking place between the two sides of the anode bag. As a result, a concentration gradient of plating ions may develop in the anode assembly illustrated in FIG. 1. The concentration of plating ions may be high close to the anode and low in the vicinity of the wafer or workpiece being plated. The concentration gradient may result in a concentration polarization. The polarization may cause the plating voltage to rise. While the concentration gradient may affect not only uniformity of wafers plated under such conditions, the concentration gradient may cause plating voltage to rise and reach its compliance value in under about 30 minutes, resulting in shut down of the plating cell.

Figure 3:
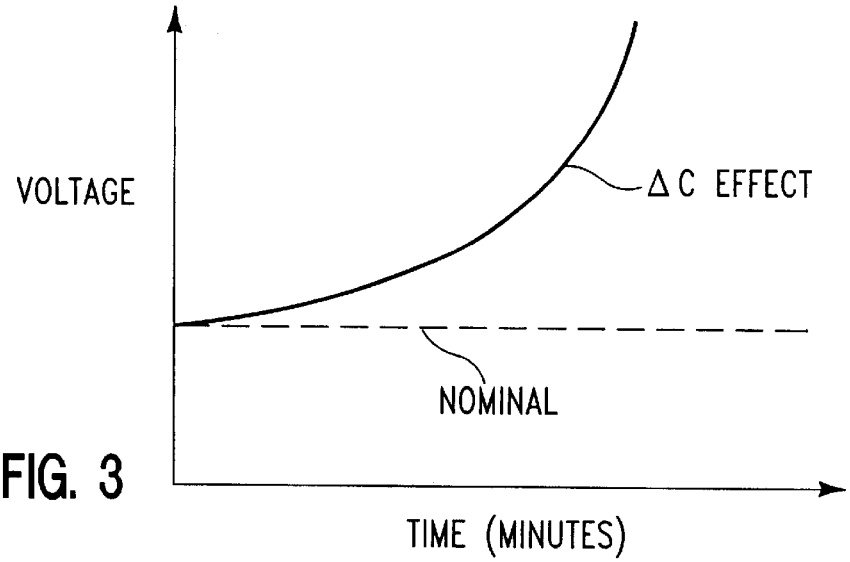
FIG. 3 represents a graph that illustrates a relationship between voltage and time and an electroplating system that includes an anode assembly such as that shown in FIG. 1.

FIG. 3 represents a graph that illustrates an effect of the concentration gradient, or $\Delta C$ between sections C and A of the anode assembly illustrated in FIG. 1, resulting in cell polarization. The broken line in the graph illustrated in FIG. 3 represents the voltage if no concentration gradient exists.

Figure 4:
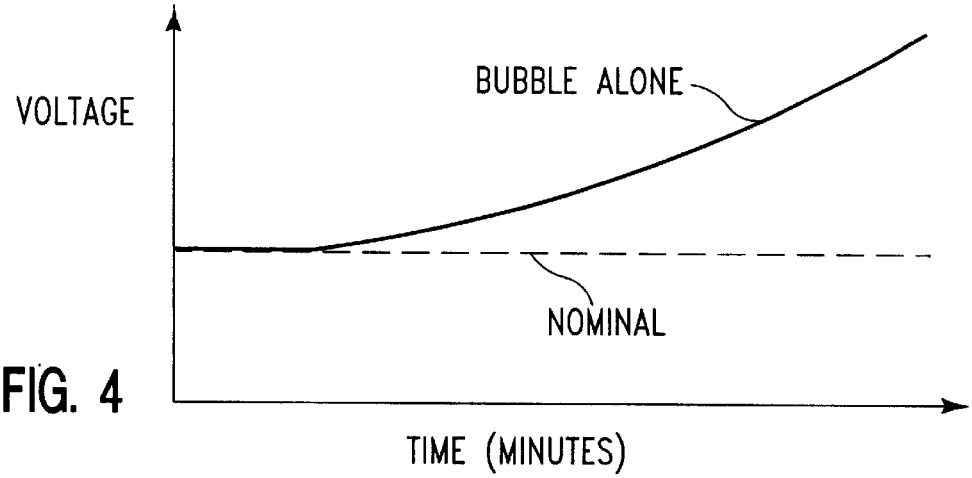
FIG. 4 represents another graph that illustrates a relationship between voltage and time and an electroplating system that includes an anode assembly such as that shown in FIG. 1.
Figure 5:
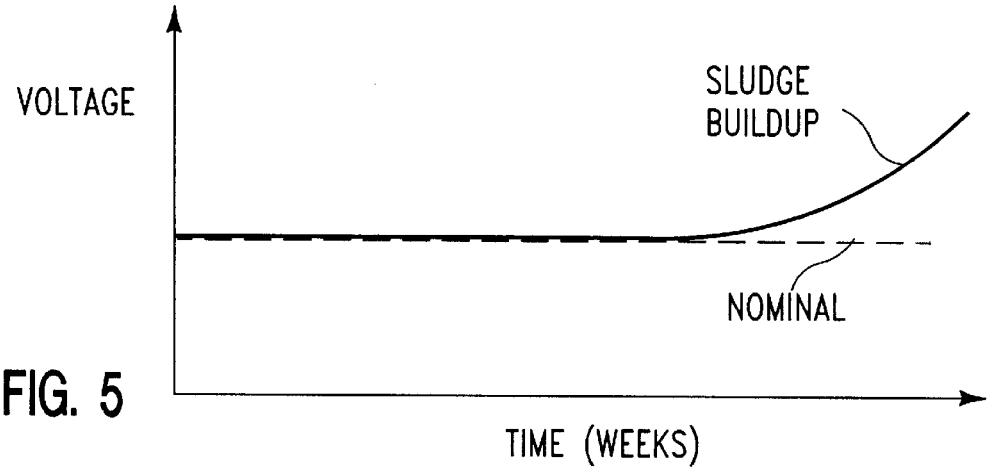
FIG. 5 represents an additional graph that illustrates a relationship between voltage and time in an electroplating system including an anode assembly such as that shown in FIG. 1.

FIG. 4 represents a graph that illustrates a relationship between voltage and time taking into account gas bubble accumulation between the anode and the anode bag in isolation, factoring out other variables. Similarly, FIG. 5 represents a graph that illustrates a relationship between voltage and time in isolation shown the affects of sludge buildup on voltage. In both FIGS. 4 and 5, the horizontal line represents the voltage in the electroplating system without the gas bubble accumulation or sludge build-up, respectively.

Embodiments of the present invention provide solutions to the above problems by providing anode assembly designs that may include a number of different elements directed to addressing, among other things, the above-described problems. For example, an anode according to the present invention may include at least one perforation. The at least one perforation may extend entirely through the anode from top to bottom in the embodiment and the orientation illustrated in FIG. 6.

The at least one perforation may have a variety of cross-sectional shapes. For example, the perforations could be circular holes provided in the anode. The holes could have a diameter of from about 3 millimeters to about 20 millimeters. Alternatively, the perforations 31 in the anode could be slits provided in the anode.

xxx By permitting plating solution to flow through the perforation(s) in the anode, the perforated anode may reduce the occurrence of a concentration gradient developing in the plating solution. As a result, the perforated anode may reduce concentration polarization in the electroplating system.

The perforations in the anode may have other functions. For example, as described below, the perforations may permit sludge to drain from the anode assembly. However, it may be beneficial to install anode bag 31*b* below the anode, to minimize bath sludge contamination.

The present invention may also include an improved anode cup or holder. Among the features of an anode cup or holder 35 according to the present invention are at least one perforation 37. As can be seen in the embodiment shown in FIG. 6, the perforation(s) 37 in the anode holder 35 may line up with perforations 33 in the anode 31 when the anode is arranged within the anode holder 35. However, it is not necessary that the perforations in the anode holder 35 and the anode 31 be aligned if they are provided such that the perforations are provided and/or the anode and anode holder are arranged relative to each other so as to permit the plating solution to flow through the anode holder and the anode.

The bulk of the plating solution flows into the cell through the numerous perforations on the cylindrical surface of the cup. The flow is such that the height of the liquid in the cell is highest at the center, as opposed to the edge.

In a different embodiment, the anode bag is omitted from between the bottom of the anode and the bottom of the anode holder. Hence, the perforation(s) in the anode and the anode holder may also act as anode sludge drain(s). Anode sludge drains can permit anode sludge to flow out and away from the anode, thereby helping to eliminate problems described above associated with anode sludge.

The perforations in the anode and the anode holder may help to improve solution renewal or exchange within the anode assembly, thereby further helping to eliminate the concentration gradient, concentration polarization, and improving plating and the overall operation of the plating cell. The perforations in the anode and the anode holder particularly provide better agitation at low flow rates within the anode compartment.

Due at least in part to its design, the anode cup of the present invention may also be mechanically strong, particularly with respect to other anode cups.

The anode holder may also include at least one opening 41 for permitting plating solution to flow into the anode holder as indicated by arrow 43. The opening 41 in the side wall of the anode holder may have a smaller cross-sectional area than the perforations 33 and 37 in the anode and anode holder. Numerous small holes, such as holes 41 and 43, at the cylindrical surface of the anode holder may serve to increase the velocity of the plating solution as it enters the plating cell. The higher velocity and the interaction of various radial flows with their wakes produce excellent agitation within the cell and in front of the workpiece, that a diffuse may no longer be necessary. As described earlier, the height of the plating solution in an embodiment according to the present invention may be highest at the center of the cell as opposed to the edge as may be the case in other designs.

In some anode assemblies, the entrance of the solution into the cell is via the eight large cut-out windows 5, such as in the anode holder in FIG. 2. The large size of the fluid entry windows tends to reduce the velocity of the fluid at the center of the cell. The highest position of the fluid in the cell is close to the large cut-outs, while the lowest region is at the center of the cell. Consequently, agitation in the cell and in front of the workpiece may not be optimal. To redistribute the fluid profile and enhance agitation in the cell, a diffuser 23 was introduced and attached to the anode holder at regions 13 adjacent to the cut-out.

The anode assembly according to the present invention may also include an anode separator for separating the anode assembly into two sections, the anode may be arranged in one section defined by the anode isolator and the workpiece being plated may be arranged on the other side of the anode isolator. According to the present invention, the anode isolator has a curvilinear cross-sectional shape as illustrated in FIG. 6.

Figure 6:
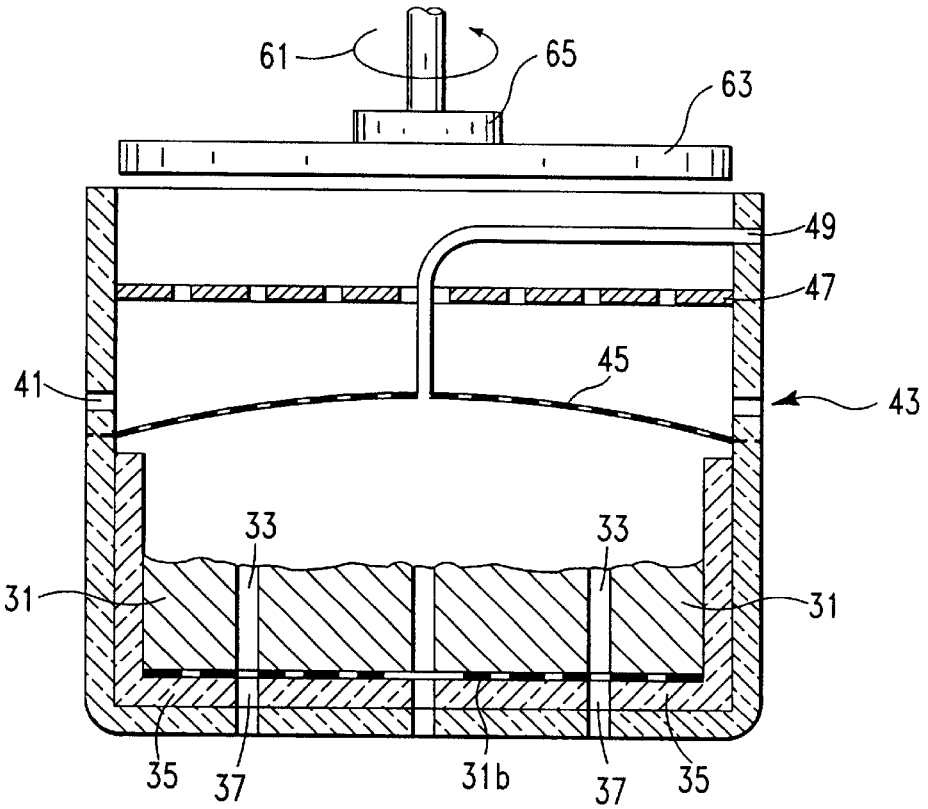
FIG. 6 represents a cross-sectional view of an embodiment of an anode assembly according to the present invention.

The anode isolator according to the present invention may include an anode bag or filter 45, illustrated in FIG. 6 and/or a diffuser 47 also illustrated in FIG. 6. The anode isolator of the present invention preferably has a curvilinear cross-sectional shape, regardless of whether it includes an anode bag and/or a diffuser.

Figure 10:
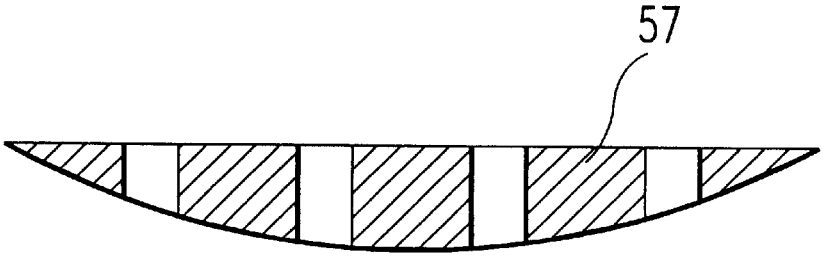
FIG. 10 represents a cross-sectional view of an embodiment of an anode assembly diffuser according to the present invention.

The curvilinear cross-section may help to isolate and eliminate gas bubbles that may exist on the anode side of the anode isolator. For example, if the anode isolator has a concave shape, such as the anode bag 45 illustrating in FIG. 6, the anode bag illustrated in FIG. 8 and the diffuser illustrated in FIG. 11, gas bubbles may tend to migrate toward the center of the anode isolator. On the other hand, if the anode isolator has a convex shape as in the diffuser and anode bag illustrated in FIG. 7 or the diffuser illustrated in FIG. 10, gas bubbles would tend to migrate toward an edge of the anode isolator.

As stated above, the anode isolator may include an anode bag and/or a diffuser. The anode bag and/or diffuser may have a curvilinear cross-sectional shape. For example, the embodiment illustrated in FIG. 6, the anode bag 45 has a curvilinear cross-section, while the diffuser 47 has a substantially flat cross section. On the other hand, the embodiment illustrated in FIG. 7, the anode bag 45 and 55 has a curvilinear cross-section.

Figure 8:
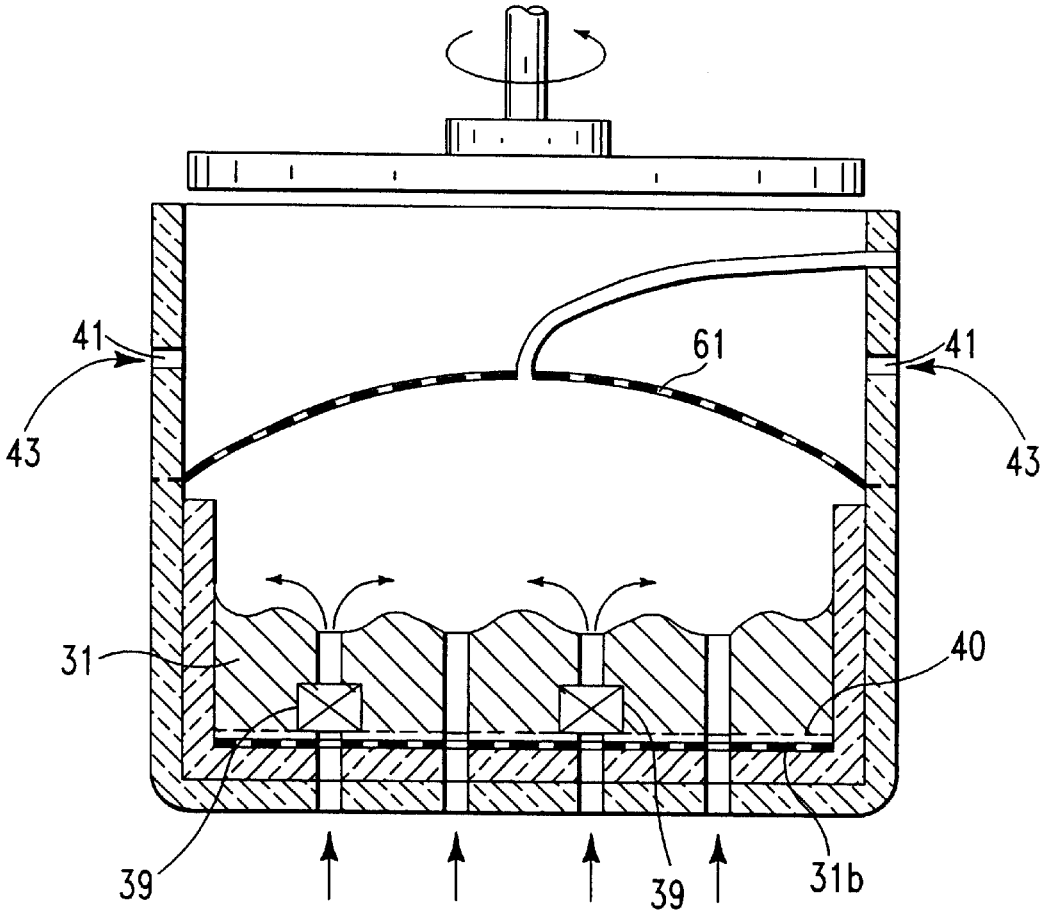
FIG. 8 represents a cross-sectional view of a further embodiment of an anode assembly according to the present invention.

According to one embodiment, the anode isolator of the present invention only includes an anode bag. FIG. 8 illustrates such an embodiment. According to such an embodiment, the function of the diffuser plate 47 has been eliminated. Liquid velocity in such an embodiment may be determined by numerous holes 41 and 43 in the top region of the anode holder cup. This represents a further simplification of the anode design and assembly. Thus, the fluid entry holes may be regarded as peripheral or cylindrical diffuser.

Figure 7:
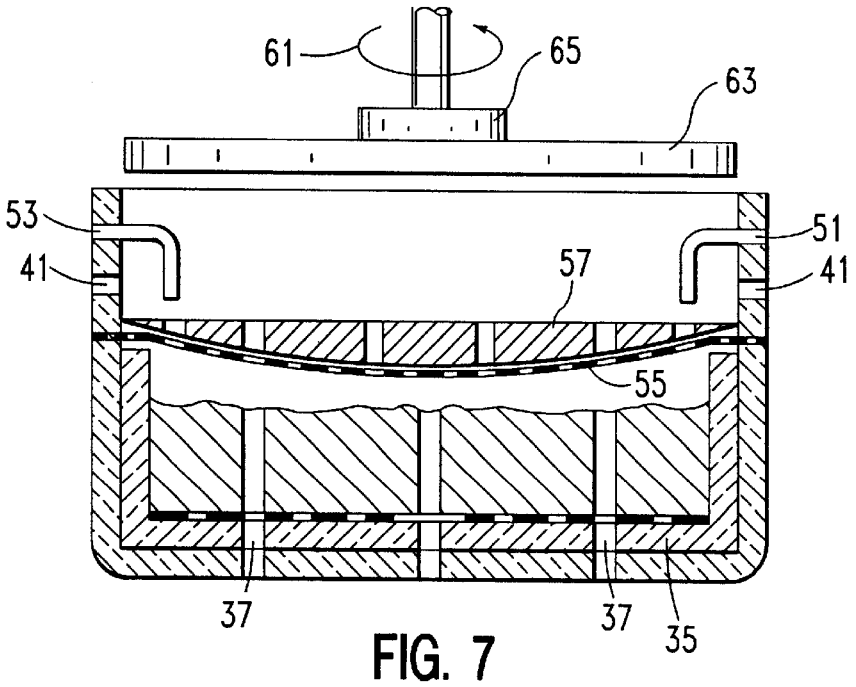
FIG. 7 represents a cross-sectional view of an another embodiment of an anode assembly according to the present invention.

The diffuser 57 in the embodiment illustrated in FIG. 7 has a curvilinear bottom surface, while the top surface of the diffuser is flat. Although the upper surface of the diffuser illustrated in FIG. 7 is flat, the upper surface may have a curvilinear cross section. If the diffuser includes a top surface having a curvilinear cross-section, it may or may not be parallel to the curvilinear bottom surface.

In an embodiment such as that shown in FIG. 7, the anode bag 55 and the bottom surface of the diffuser 57 may be in close proximity or even in contact. In fact, the anode bag may be joined to the surface of the diffuser. In any embodiment where the anode isolator includes an anode bag, the anode bag may be connected to the anode holder or to the diffuser. For example, in the embodiment illustrated in FIGS. 6 and 8, the anode bag is connected to the anode holder. For example, in the embodiment illustrated in FIG. 8, the anode bag is connected to the anode holder with a bag holder 61. On the other hand, the anode bag may be connected to the diffuser as in the embodiment illustrated in FIG. 7.

Figure 11:
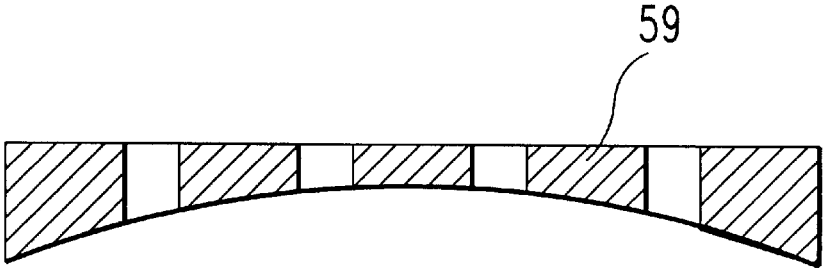
FIG. 11 represents a cross-sectional view of another embodiment of an anode assembly diffuser according to the present invention.

FIG. 11 illustrates a diffuser 59 that includes a bottom surface having a curvilinear cross-sectional shape. The diffuser illustrated in FIG. 11 includes a top surface that is flat. However, just like the diffuser illustrated in FIG. 7, the diffuser illustrated in FIG. 11 may include a top surface having a curvilinear cross-sectional shape.

Figure 9:
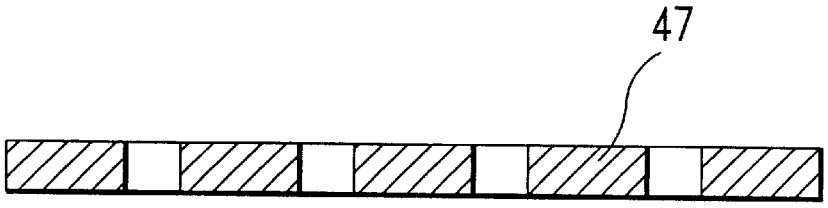
FIG. 9 represents a cross-sectional view of a diffuser for use in an anode assembly.

In most cup plating cells, the uniformity of thinner electroplated films, for example, less than about 1.0 $\mu$m, tend to be worse than those of thicker film, for example, greater than about 1.3 $\mu$m. Depending on the attributes of the cell design, the plated metal tends to be thicker near the edge of the workpiece than at its center, as the metal deposit evolves. Thus, plated metal uniformity tends to improve as the deposit becomes thicker. The uniformity of an approximately 0.75 $\mu$m plated copper on a die substrate of about 200 mm on a seedlayer about 500 Å thick will produce a uniformity of about 10%±3 with a conventional diffuser shown in FIG. 9 or a domed diffuser illustrated in FIG. 10.

Of special interest is the novel diffuser illustrated in FIG. 11. In the diffuser shown in FIG. 11, the center of the diffuser has been reduced linearly from the edge with nominal thickness of about 3 mm to the center, where the thickness is only about 1.5 mm. The use of such a novel diffuser may improve the uniformity of thin electrodeposits. For example, the uniformity of approximately 0.75 $\mu$m plate film may be reduced from about 10±3% to about 6±2%. Hence, in an application where a more uniform thin electrodeposit may be required, the diffuser in FIG. 11 may be preferable to the conventional or the domed diffuser in FIGS. 9 and 10.

The size, design, and/or pattern of holes at the bottom of the anode holder may be as large and numerous as practical. One practical limitation on the characteristics of the holes is that they permit enough material be left at the bottom of the anode holder so as to permit it to support the weight of the anode material.

During plating operations, the perforation(s) in the anode may enlarge as a result of anode dissolution. The holes in the anode, prior to commencing plating, may have dimensions of from about 2 mm to about 5 mm. On the other hand, the holes may be enlarged to over five times their original size, toward the end of the anode life.

Typically, the diameter of the initial anode perforation(s) may be between about 1.5 mm and about 6 mm. More typically, the holes have a diameter of between about 2 mm and about 4 mm. Large dimension holes do not offer an advantage. In fact, large diameter holes may reduce the life of the anode by excluding materials that would ordinarily have been plated.

The number of anode perforations could range from about 3 to about 200. However, it is typically, the anode includes about 10 to about 20 perforations in the anode. Most typically, the anode includes between about 20 and about 70 perforations.

The holes in the anode may be made to align with the holes in the anode holder. However, this is not necessary. For example, the holes could be offset from each other. Alternatively, the holes could be in a series of a few cut-outs or in a particular design at the bottom of the anode holder. This may especially be the case because of the presence of a lower anode bag 31*b* and the optional addition of a titanium mesh between the anode material and the anode bag. Typically, the size of the titanium mesh could range from about 3 mesh/in. to about 25 mesh/in. More typically, the size of the mesh is about 15 mesh/in.

An apparatus according to the present invention may also include a bleeder tube 49. The bleeder tube may be of importance in controlling conditions within the plating cell. For example, in the absence of a bleeder tube, air or gas bubbles may accumulate below the anode bag, and above the anode material.

The air or gas bubbles may not only cause undesirable cell polarization, but may also distort the uniformity of the plated film. This is because the electric field has to bend around the air or gas bubbles before the field arrives at the workpiece. When the gap between the workpiece and the anode bag is much smaller than the diameter of the anode, the primary of a secondary current distribution may be highly distorted. This distortion from the preferred parallel lines produces undesirable metal deposit uniformly on the workpiece.

The internal diameter (i.d.) of the bleeder tube may typically range between about 1.5 mm to about 4 mm. More typically, the internal diameter of the bleeder tube may be between about 2 mm to about 3 mm. Tubes having a smaller internal diameter may not be very practical, because they are easily clogged by anode fines or particles. On the other hand, while tubes having a large internal diameter may be used, the difficulty of forming the tubes to the appropriate shape in the small space between the workpiece and to the top of the bag may limit the diameter of the tube that could be used. The outer diameter of the tube typically is not of great significance. Typically, the wall of the bleeder tube is sufficiently thick to prevent it from collapsing or pinching off during the tube shaping operation.

One weakness of some anode holders, such as that shown in FIG. 2, as a result of large cut-outs or fluid entrance windows 5, the strength of the remaining portions 5 may be much weaker. Such anode holders may require very careful handling. Occasionally, the remaining portion 5 may develop cracks around its foot 13*b*, and break in an unpredictable manner or time.

According to the present invention, the edge of the anode holder may not be weakened by large cut-out. Rather, a series of perforations may be drilled around the anode holder to replace the large cut-out sections. The shape of the openings may be circular, rectangular, oval, or any other suitable shape. The diameter of the hole(s) could range from about 2 mm to about 6 mm. Typically, the hole(s) have a diameter of about 2 mm to about 4 mm. Also, the spacing between each hole could be between about 1 to about 5 hole diameters. Typically, the holes are spaced apart by about 1.5 to about 4 hole diameters. Additionally, the number and/or diameter of the holes typically results in being able to pump in to the anode holder more than about 7 gpm of plating solution ¾ hp centrifugal pump.

Regardless of the shape of the anode isolator and whether the anode isolator includes an anode bag and/or diffuser, the anode assembly of the present invention may include at least one anode isolator gas bleed for bleeding gas from the side of the anode isolator facing the anode, in other words, the "A" section of the anode assembly. For example, the embodiment illustrated in FIG. 6 includes one anode isolator gas bleed 49. On the other hand, the embodiment illustrated in FIG. 7 includes at least 2 anode isolator gas bleeds 51 and 53. An embodiment of the present invention such as that illustrated in FIG. 7 may include any number of anode isolator gas bleeds to result in the desired venting of gas from the anode side of the anode isolator.

The anode isolator gas bleed or bleeds may be any sort of tube. Typically, the tube is a non reactive plastic material. However, other materials could be utilized. The gas bleed(s) may be connected to the anode isolator utilizing any suitable connector.

An embodiment of the present invention such as that illustrated in FIG. 7 may include an anode isolator that is contoured in addition to being curvilinear so as to encourage any gas bubbles to migrate toward the gas bleed(s) arranged around the parameter of the anode isolator. Along these lines, the shape of the anode isolator as well as the provision of the anode isolator gas bleeds may help to eliminate air from the anode side of the anode isolator by helping to push the air either toward the center or toward the edges of the anode isolator. By controlling the amount of gas on the anode side of the anode isolator, the present invention may control deposit uniformity since the gas bubbles may affect the plating solution, concentration of ions in the plating solution, concentration gradient, concentration polarization, and plating voltage, as described above.

The present invention may also include at least one mesh layer arranged between the anode and the anode holder. According to one embodiment, the present invention includes two mesh layers. The mesh may be made of a variety of conducting materials. According to one embodiment, the mesh layer or layers are made of titanium.

The mesh may be provided in the anode assembly according to the present invention to improve current distribution of the anode. This is because the titanium mesh assists in carrying electrical current to the outer diameter of the anode, toward the end of the anode life. Additionally, the mesh may prolong anode life.

Also, the mesh may also help to reduce anode dissolution on the back side of the anode, the side that faces the anode holder. The presence of the titanium mesh on the backside of the anode, may enhance the formation of a very adherent anode film on the backside of the anode. The presence of a continuous and adherent anode film on the anode backside may not only reduce anode dissolution, but ma also reduce additives consumption in the cell.

Of special significance is the anode electrical contact assembly. Electrical contact to the anode may be made through a titanium hub/flange. Such a hub or flange may be screwed to the anode by two or more screws.

Below the washer, but above the lower anode bag may be a titanium mesh. The titanium mesh may enhance current distribution to various portions of the anode. The titanium mesh may also enhance the formation of a continuous adherent anode film on the backside of the anode. This not only produces controlled and predictable anode dissolution, it also reduces addition consumption in the cell.

The design of a blind threaded hole in the hub as opposed to a through-hole into the copper, may further prolong anode life. In the case where hole ended in the anode as opposed to inside a titanium contact assembly, after prolonged plating operation, the high current density where the hole ends in the anode may cause rapid anisotropic dissolution of the anode in regions above the contact. This may result in plating solution contaminating the interface between the anode electrical contact assembly and the anode itself. The results can be an occasional loss of electrical contact integrity between the anode electrical contact and the anode may cause the plating voltage to oscillate in a very unpredictable manner. The dissolution of the anode metal in this region, tends to shorten anode life.

As with the embodiment illustrated in FIG. 1, the embodiments of the present invention illustrated in FIGS. 6 through 8 may include a workpiece or wafer and apparatus to support the wafer workpiece 65. The arrows 67 indicate that the workpiece or wafer and the supporting structure may be rotated.

The present invention also includes an electroplating system that includes an anode assembly such as that described above. The electroplating system may also include a plating tank that holds plating solution including at least one metal to be plated on at least one substrate. The anode assembly may be arranged within the electroplating tank.

The present invention also includes methods of electroplating at least one metal on a substrate. The method includes providing an electroplating system such as that described above. At least one substrate may be arranged in the electroplating system and current supplied to the at least one substrate to result in the plating of at least one metal or alloy contained within the plating solution onto at least a portion of the substrate. The method may also include bleeding gas from the anode side of the anode isolator. Furthermore, methods of the present invention may also include draining sludge through at least one opening, such as one of the perforations described above, in the anode holder.

Figure 12:
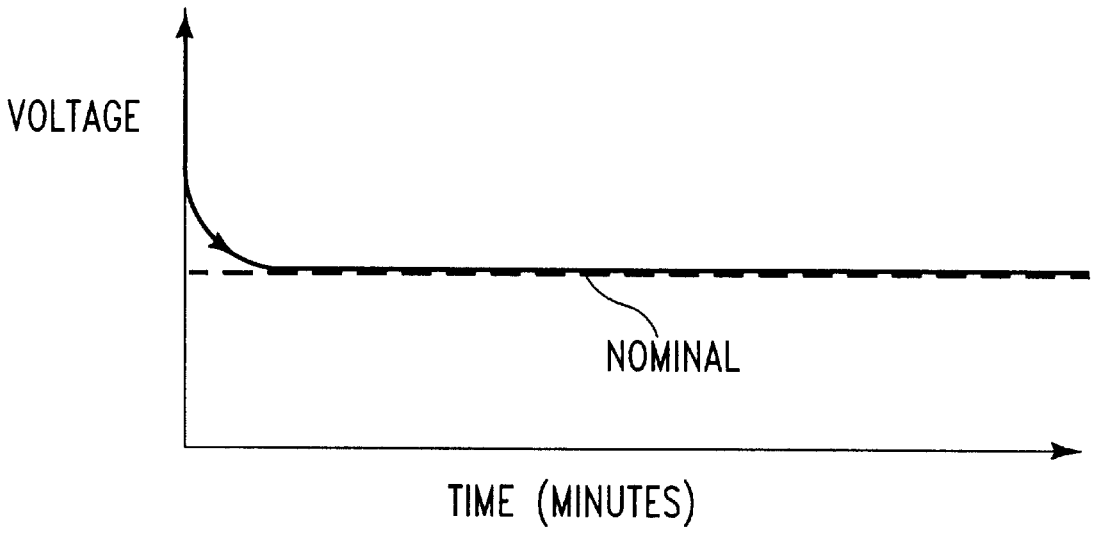
FIG. 12 represents a graph that illustrates a relationship between voltage and time in an electroplating assembly that includes an anode assembly according to the present invention.

FIG. 12 represents a graph that illustrates a relationship between voltage and time when utilizing an anode assembly according to the present invention. As can be seen in FIG. 12, the present invention helps to eliminate the voltage fluctuations shown in the graphs illustrated in FIGS. 3–5.

Figure 13:
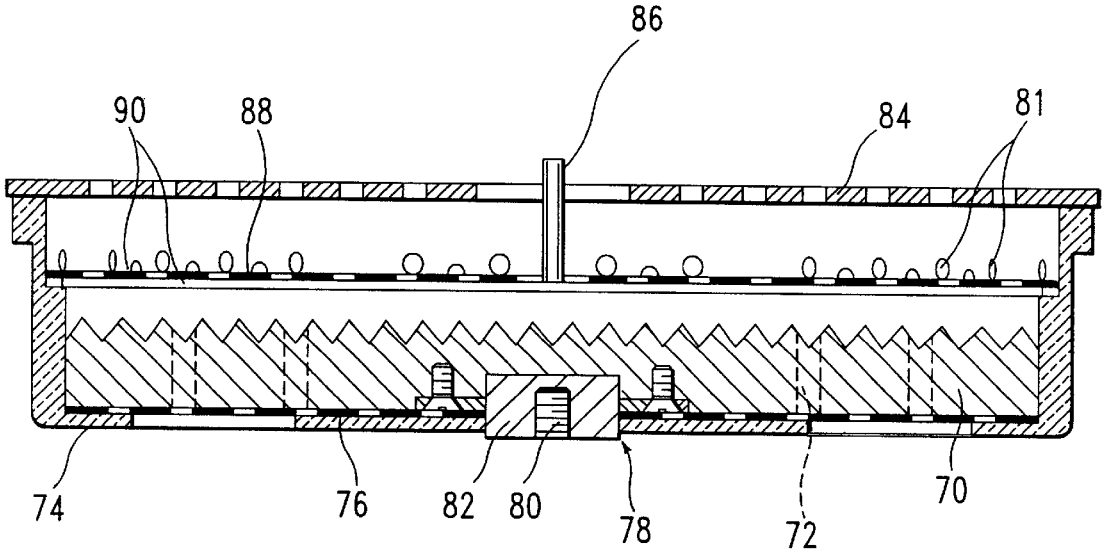
FIG. 13 represents a cross-sectional view another embodiment of an anode assembly according to the present invention.

FIG. 13 provides a cross-section of an embodiment of an anode assembly according to the present invention. In the embodiment shown in FIG. 13, an anode 70 including passages 72 is housed within anode holder 74. A titanium mesh 76 is arranged between anode 70 and anode holder 74. The anode holder may include a plurality of passages 81 as described above. Electrical contact to the anode may be made through anode electrical contact assembly 78. As described above, contact assembly 78 may include contact 80 screwed into insert 82. Diffuser 84 may be arranged over anode 70. At least one bleed tube 86 may be provided in an anode bag 88 and diffuser 84. The anode filter or bag 88 may be arranged at least over the anode 70. The anode bag may be arranged in a frame 90.

Figure 14:
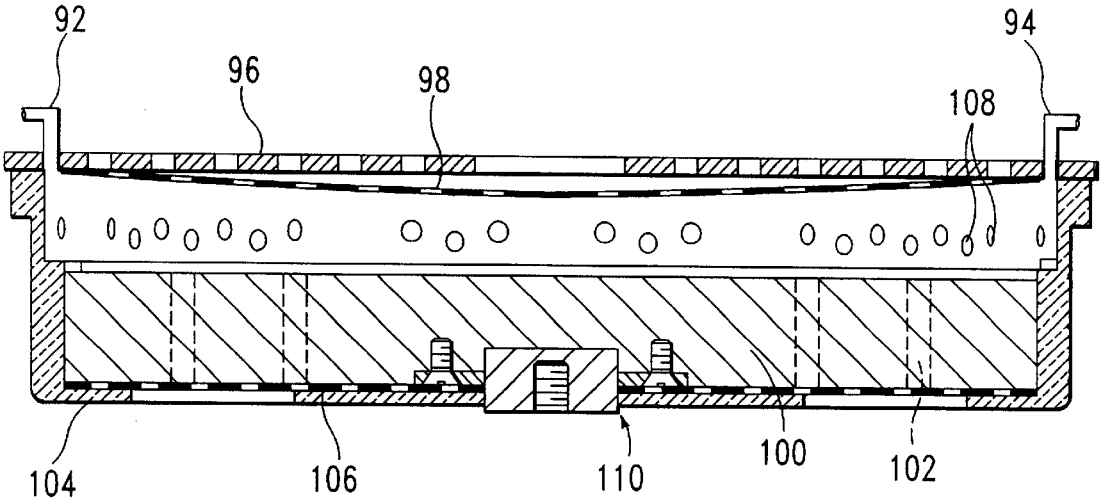
FIG. 14 represents a cross-sectional view another embodiment of an anode assembly according to the present invention.

The embodiment illustrated in FIG. 14 includes bleed tubes 92 and 94 arranged at the periphery of the diffuser 96 and anode bag 98. Similarly to above, the embodiment shown in FIG. 14 includes an anode 100 including passages 102 housed within an anode holder 104. A titanium mesh 106 is arranged between anode 100 and anode holder 104. The anode holder 104 may include a plurality of passages 108 as described above. Electrical contact to the anode may be made through anode electrical contact assembly 110.

Figure 15:
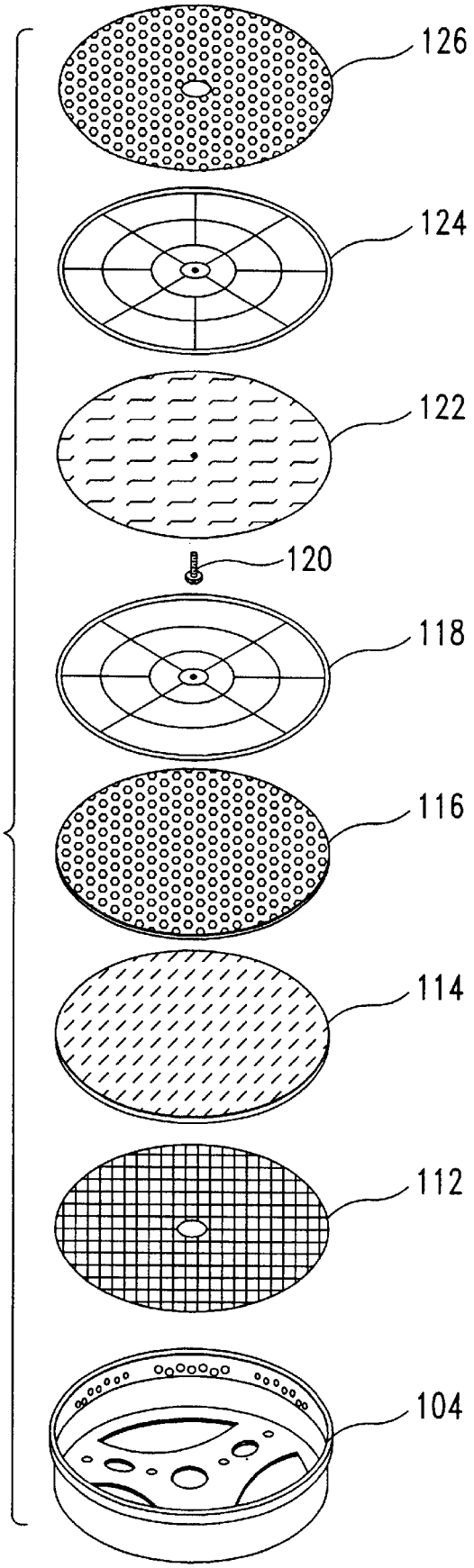
FIG. 15 represents an exploded view of another embodiment of an anode assembly according to the present invention.

FIG. 15 illustrates an exploded view of an embodiment of an anode assembly according to the present invention. The embodiment illustrated in FIG. 15 includes anode holder 104, titanium mesh 112, lower anode filter 114, perforated anode 116, lower frame member 118, gas bleed tube 120, upper anode filter 122, upper frame member 124, and diffuser 126.

Among the advantages of the present invention are to minimize or eliminate the concentration gradients. The present invention accomplishes this through controlling the gas bleeding, among other ways.

The present invention also provides simple and elegant solutions to the problems described above that exist with other anode assemblies.

The present invention also makes it possible to dramatically improve plating cell productivities. As compared to an embodiment such as that illustrated in FIG. 1, the present invention may produce an anode usage of higher than about 85%. On the contrary, the embodiment illustrated in FIG. 1, the anode may be discarded after only utilizing 30% of the anode. Additionally, by controlling sludge, the present invention may eliminate the necessity of removing the anode from the cell to clean sludge.

The present invention may eliminate the lengthy anode reconditioning processes. Additionally, by addressing problems that effect the voltage, voltage polarization issues could be eliminated by the present invention.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. An anode assembly, comprising:

a perforated anode;

a perforated anode holder for holding the anode, the anode holder including perforations at least in a bottom wall such that plating solution may flow through perforations in the anode holder and perforations in the anode;

an anode isolator extending across the anode holder for separating the anode and a cathode, the anode isolator including at least one curvilinear surface that faces the anode and a surface that faces the cathode; and at least one anode isolator gas bleed for bleeding gas from the anode assembly from a side of the anode isolator facing the anode.

2. The anode assembly according to claim 1, wherein the anode holder is also perforated on a side surface for permitting plating solution to flow into the anode holder.

3. The anode assembly according to claim 1, wherein the anode isolator includes at least one member selected from the group consisting of a diffuser and an anode bag.

4. The anode assembly according to claim 3, wherein the diffuser is convex or concave.

5. The anode assembly according to claim 2, wherein the anode isolator includes the diffuser and the anode bag and wherein the anode bag is connected to the diffuser.

6. The anode assembly according to claim 1, further comprising:

at least one anode sludge drain provided in the bottom wall of the anode holder.

7. The anode assembly according to claim 6, further comprising:

at least one valve arranged in the at least one anode sludge drain.

8. The anode assembly according to claim 1, wherein the anode comprises CuP.

9. The anode assembly according to claim 1, further comprising:

at least one mesh layer arranged between the anode and the anode holder.

10. The anode assembly according to claim 1, wherein the at least one gas bleed is centrally arranged on the anode isolator.

11. The anode assembly according to claim 1, including a plurality of gas bleeds arranged about the periphery of the anode isolator.

12. The anode assembly according to claim 3, wherein the anode isolator includes the diffuser and the diffuser includes a plurality of passages formed therethrough.

13. An electroplating system, comprising:

a plating tank for holding a plating solution including at least one metal to be plated on at least one substrate;

a perforated anode holder arranged within the plating tank for holding an anode, the anode holder including perforations at least in a bottom wall such that plating solution may flow through perforations in the anode holder and perforations in the anode;

a perforated anode arranged within the anode holder;

an anode isolator extending across the anode holder for separating the anode and a cathode, the anode isolator including at least one curvilinear surface that faces the anode and a surface that faces the cathode; and at least one anode isolator gas bleed for bleeding gas from the anode assembly from a side of the anode isolator facing the anode.

14. The electroplating system according to claim 13, wherein the anode holder is also perforated on a side surface for permitting plating solution to flow into the anode holder.

15. The electroplating system according to claim 13, wherein the anode isolator includes at least one member selected from the group consisting of a diffuser and an anode bag.

16. The electroplating system according to claim 15, wherein the diffuser is convex or concave.

17. The electroplating system according to claim 13, further comprising:

at least one anode sludge drain provided in the bottom wall of the anode holder; and at least one valve arranged in the at least one anode sludge drain.

18. The electroplating system according to claim 13, further comprising:

at least one mesh layer arranged between the anode and the anode holder.

19. The electroplating system according to claim 14, wherein the at least one gas bleed is centrally arranged on the anode isolator or about the periphery of the anode isolator.

20. The electroplating system according to claim 15, wherein the anode isolator includes the diffuser and the diffuser includes a plurality of passages formed therethrough.

21. The electroplating system according to claim 15, wherein the anode isolator includes a diffuser that has a cylindrical shape for controlling agitation and uniformity of metal deposited by the electroplating system.

22. The electroplating system according to claim 21, wherein the diffuser is thinner at a center portion than at a peripheral portion.

23. The electroplating system according to claim 21, wherein the diffuser is thicker at a center portion than at a peripheral portion.

24. The electroplating system according to claim 21, wherein the diffuser includes a plurality of passages therethrough, wherein the passages have cross-sections for controlling flow of plating solution.

25. The electroplating system according to claim 21, wherein the diffuser includes at least one curvilinear surface to control flow of plating solution and uniformity of metal deposited by the plating solution.

26. A method of electroplating a material on a substrate, the method comprising the steps of:

providing an electroplating system including a plating tank for holding a plating solution including at least one metal to be plated on said at least one substrate, an open space existing above an upper surface of said plating solution, a plating solution contained within the electroplating cell, a perforated anode, a perforated anode holder for holding the anode, the anode holder including perforations at least in a bottom wall such that plating solution may flow through perforations in the anode holder and perforations in the anode, an anode isolator extending across the anode holder for separating the anode and a cathode, the anode isolator including at least one curvilinear surface that faces the anode and a surface that faces the cathode, and at least one anode isolator gas bleed for bleeding gas from the anode assembly from a side of the anode isolator facing the anode;

introducing at least one substrate into said plating tank;

supplying current to the at least one substrate to result in the plating of at least one metal contained within the plating solution on to at least a portion of the substrate; and bleeding gas generated during plating of the at least one metal or alloy on the substrate.

27. The method according to claim 26, further comprising the steps of:

providing the bottom wall the anode holder with at least one anode sludge drain;

draining through the at least one anode sludge drain sludge generated during plating of the at least one metal or alloy on the substrate.

* * * * *

UNITED STATES PATENT AND TRADEMARK OFFICE

CERTIFICATE OF CORRECTION

PATENT NO. : 6,251,251 B1
DATED : June 26, 2001
INVENTOR(S) : Cyprian E. Uzoh et al.

It is certified that error appears in the above-identified patent and that said Letters Patent is hereby corrected as shown below:

Column 2,
Line 31, delete "an".
Line 50, after "view" insert -- of --.
Line 53, after "view" insert -- of --.

Column 3,
Line 36, delete "or" (first occurrence).

Column 5,
Line 23, delete "xxx".

Column 14,
Line 24, after "wall" insert -- of --.

Signed and Sealed this

Fifteenth Day of January, 2002

*Attest:*

*Attesting Officer*

JAMES E. ROGAN
*Director of the United States Patent and Trademark Office*